US010883394B2

(12) United States Patent
Stanhope

(10) Patent No.: US 10,883,394 B2
(45) Date of Patent: Jan. 5, 2021

(54) SUPPORT ARRANGEMENT FOR AN ACTUATOR OF A CAM PHASER

(71) Applicant: ECO Holding 1 GmbH, Marktheidenfeld (DE)

(72) Inventor: Daniel Stanhope, Nunica, MI (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/411,768

(22) Filed: May 14, 2019

(65) Prior Publication Data

US 2020/0362732 A1 Nov. 19, 2020

(51) Int. Cl.

| | |
|---|---|
| ***F01L 1/344*** | (2006.01) |
| ***H01F 7/14*** | (2006.01) |
| ***H01F 7/126*** | (2006.01) |
| *F01L 9/04* | (2006.01) |

(52) U.S. Cl.

CPC ..... *F01L 1/344* (2013.01); *H01F 7/126* (2013.01); *H01F 7/14* (2013.01); *F01L 2009/0446* (2013.01); *F01L 2820/032* (2013.01)

(58) Field of Classification Search

CPC ..... F01L 1/344; F01L 2009/0446; F01L 2820/032; F01L 2101/00; F01L 1/46; F01L 2201/00; H01F 7/126; H01F 7/14

USPC ..... 123/90.15, 90.17, 90.11; 439/441, 843

See application file for complete search history.

(56) References Cited

U.S. PATENT DOCUMENTS

| | | | | |
|---|---|---|---|---|
| 8,443,772 | B2 * | 5/2013 | Kokubo | F01L 1/022 123/90.15 |
| 9,470,118 | B2 * | 10/2016 | Kokubo | F01L 1/047 |
| 2016/0123194 | A1 * | 5/2016 | Kajiura | F01L 1/344 123/90.15 |

FOREIGN PATENT DOCUMENTS

| | | |
|---|---|---|
| DE | 102013013659 A1 | 2/2015 |
| DE | 102016221990 A1 | 5/2017 |

* cited by examiner

*Primary Examiner* — Patrick Hamo
*Assistant Examiner* — Wesley G Harris
(74) *Attorney, Agent, or Firm* — Von Rohrscheidt Patents

(57) ABSTRACT

A support arrangement for an actuator of a cam phaser, the support arrangement including an actuator module including an actuator; and a support element configured to support the actuator module on a camshaft, wherein the actuator module is connected to the support element by an electrical contact arrangement configured to actuate the actuator, and wherein the electrical contact arrangement includes an elastic clamping element.

11 Claims, 2 Drawing Sheets

SUPPORT ARRANGEMENT FOR AN ACTUATOR OF A CAM PHASER

FIELD OF THE INVENTION

The invention relates to a support arrangement for an actuator of a cam phaser, with an actuator module including an actuator, and a support element for supporting the actuator module on a camshaft.

BACKGROUND OF THE INVENTION

Cam phasers are used in valve trains of internal combustion engines to be able to set the phase relationship between the crankshaft and camshaft optimally and variably.

Support arrangements for the actuator or actuator drive for the cam phaser have been known for some time in the prior art. DE 102013013659 A1 discloses for example an assembly with at least one camshaft adjustment magnet and a support for attachment to a cylinder head of an internal combustion engine. As a further example, reference is made to publication DE 102016221990 A1 which discloses an electromagnetic actuator device with a housing, wherein the housing comprises amongst other elements a unit for fixing to a component receiving the electromagnetic actuator device.

BRIEF SUMMARY OF THE INVENTION

The object of the invention is to improve the structure and function of a support arrangement of the type cited initially, and facilitate its installation.

According to one aspect, the object is achieved by a support arrangement for an actuator of a cam phaser, with an actuator module comprising an actuator, and a support element for supporting the actuator module on a camshaft. Here, the actuator module is connected to the support element by means of an electrical contacting for actuating the actuator, wherein the electrical contacting comprises an elastic clamping element.

Advantageous embodiments are provided in the dependent claims.

The improved support arrangement brings the advantage that, because of its modular structure, various installation positions are possible. Also, the design allows lower production costs since the arrangement can be produced in very high numbers to allow applications with lower quantities and different interface mounting requirements. In particular, it is possible to adapt an actuator and an actuator housing for different customer-specific interfaces, since only the support element is adapted to the corresponding interface. Different mounting configurations can be produced on one production line and adapted customer-specifically by means of the support element. Also, by means of the elastic clamping element, a fixed but still releasable electrical contacting is created. The clamp connection allows compensation for stresses and vibrations, whereby service life is extended and failure probability reduced. Damage to welded or soldered contacts can no longer occur. Irrespective of this, the actuator or actuator module may be tested for function before fitting to the support element.

Also, the actuator inside the actuator module is preferably an electromagnetic actuator.

According to an advantageous embodiment, the elastic clamping element is arranged on the support element. This means that the actuator contact is arranged externally on the actuator module so as to achieve the electrical contacting to the clamping element. In this way, the customer-specific adaptations are located entirely on the side of the support element. This increases the possible quantities for series production of the actuator module.

In a particularly advantageous embodiment, the elastic clamping element comprises a first clamping means and a second clamping means. The two clamping means are arranged separately or isolated from each other. By means of the two clamping means, an electrical circuit can be created which for example controls an electromagnet inside the actuator module. The electromagnet can thus be activated or deactivated and/or its polarity reversed.

The clamping means are preferably arranged parallel to each other. A parallel arrangement of the two clamping means is suitable in particular when the actuator contact is formed as a standard plug and hence with two plug pins arranged parallel to each other.

Also, the clamping element preferably comprises at least a first clamping arm for fixedly clamping an actuator contact, in particular, the one or both clamping means of the clamping element are formed with a clamping arm. The clamping arm is arranged such that on electrical contacting, the actuator contact is loaded or clamped by means of the clamping arm. In this way, the electrical contacting is particularly stable but can still compensate for stresses and vibrations.

According to a preferred embodiment, the clamping element comprises a second clamping arm for fixed clamping the actuator contact, wherein the second clamping arm is arranged opposite the first clamping arm. The actuator contact is thus clamped between the two clamping arms. The electrical contacting thus becomes more stable and more secure.

According to a further preferred embodiment, the clamping element comprises a third clamping arm for fixedly clamping the actuator contact, wherein the three clamping arms together form an M-shaped receiver for the actuator contact. The three clamping arms are arranged as an M-slot, wherein one of the clamping arms extends between the other two, mutually opposite clamping arms. As well as a particularly stable and secure contacting, with this arrangement it is also possible for the actuator contact to latch into the clamping element. For this, the actuator contact is formed wider on its side facing the support element than on its side facing away from the support element. The M-shaped slot also has the advantage that differently configured actuator contacts with different shape, size and orientation can be gripped or clamped.

According to the invention, advantageously the clamping arm is arranged at an angle of between 0° and 80°, preferably between 10° and 60°, to a longitudinal axis of the clamping element. The clamping arm, in a state in which the actuator module is held on the support element, is bent in a direction facing away from the actuator module. This has the advantage that, for example, the actuator contact can be introduced more easily into the clamping element. Also, subsequent release or extraction of the actuator contact becomes more difficult since the clamping arm acts as a claw. A particularly stable retention of the actuator contact is achieved if several bent clamping arms are arranged on the clamping element.

In an advantageous embodiment, the clamping element is arranged in at least one sealed pocket of the support element. For this, preferably, a sealant is provided for sealing the pocket on the side facing away from the actuator module. Particularly preferably, the pocket is sealed oil-tightly on this side. The pocket is initially configured still open so as to facilitate assembly and allow quality control. After complete installation and function test, the pocket is sealed on the outside by means of the sealant.

In a further embodiment, the support element has a surrounding plastic molding. The plastic molding is preferably produced by injection molding. Thus a particularly firm and sealed connection is formed between the inner components of the support element.

According to an additional advantageous embodiment, the support element is welded to the actuator module. Welding preferably takes place using ultrasound welding. Ultrasound welding is a method for joining thermoplastics and metallic materials. The welding is carried out by a high-frequency mechanical vibration in the range from usually 20 to 35 kHz, which leads to heating between the components due to molecular and interface friction, and in metals also to toothed engagement and interlocking of the joint partners. By means of the welding, in particular the ultrasound welding, the support element and actuator module are fixedly connected together. With ultrasound welding, also costs are saved since no additional materials are required in this method.

In a further preferred embodiment, the actuator module has at least one outwardly protruding pin which can be introduced into a corresponding depression of the support element. Thus the pin guarantees a precise positioning on joining of the actuator module and support element. A precise interplay of support element and actuator module is thus guaranteed.

In a refinement, the pin is preferably designed for welding to the support element. Preferably, at least two and particularly preferably three pins are arranged on the actuator module, which can each be introduced into a corresponding depression of the support element. The protruding ends of the pins are welded to the support element, preferably by ultrasound welding. This gives a precisely positioned and secure connection between the actuator module and the support element.

In a further embodiment, a radial seal is provided on the circumference of the actuator module. The seal is preferably formed as a sealing ring which allows an oil-tight contact of the actuator module on the support element.

BRIEF DESCRIPTION OF THE DRAWINGS

Further advantages of the invention can be derived from the description and the drawing figures. The drawing is explained in more detail below with reference to the exemplary embodiment shown in the drawing figures, wherein.

DETAILED DESCRIPTION OF THE INVENTION

Figure 1:
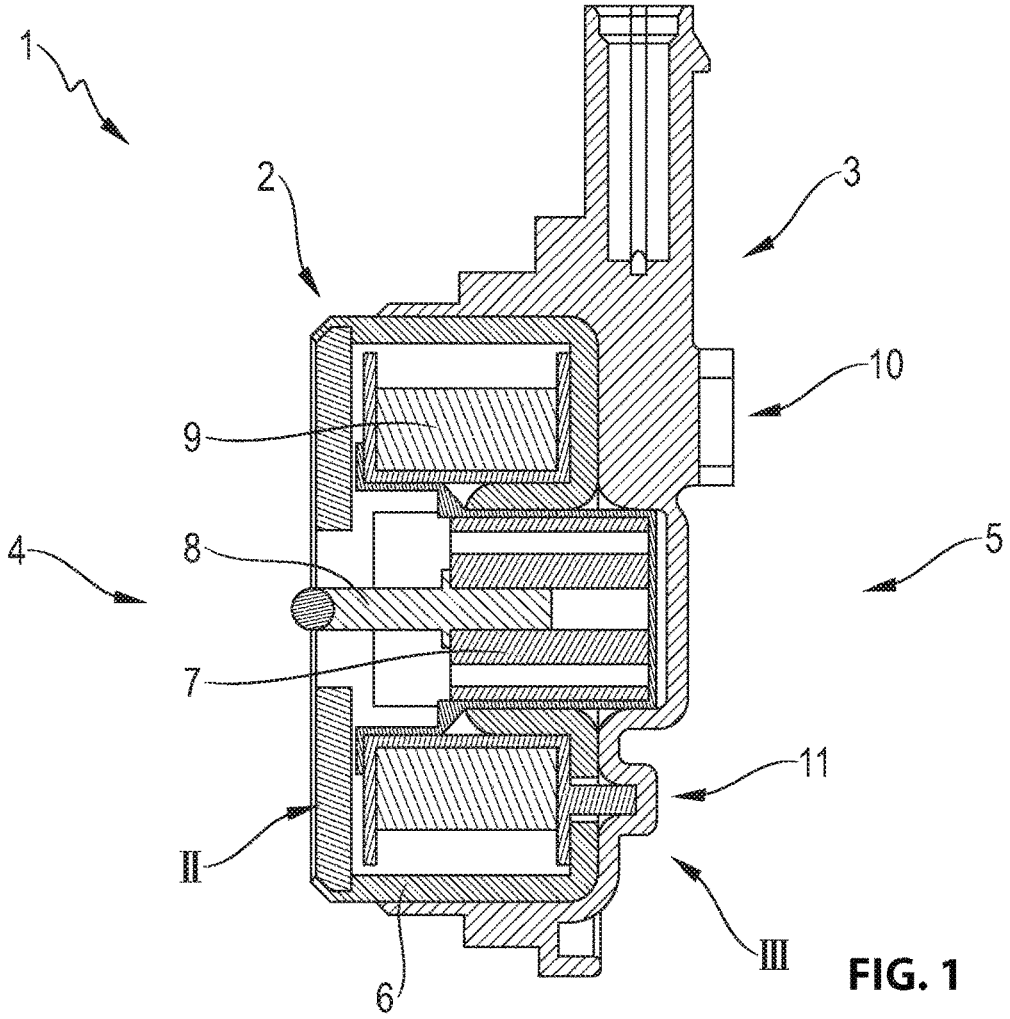
FIG. 1 illustrates an exemplary embodiment of a support arrangement according to the invention in a longitudinal sectional view.

FIG. 1 shows a support arrangement) according to the invention which comprises an actuator module 2 and a support element 3. Accordingly and for descriptive purposes, an actuator module side 4 and a support element side 5 are defined and designated in FIG. 1 and the following figures. The actuator module 2 comprises a housing 6 with a rotational body 7, a connecting rod 8 and a magnetic coil 9. The support element 3 surrounds a part of the actuator module 2 and is connected thereto by means of an electrical contacting 10 (not visible here) so as to conduct electrical current and signals. The electrical contacting 10 is formed by two actuator contacts (not shown) of the actuator module 2 and an elastic clamping element (not shown) formed with two clamping means. Mechanically, the support element 3 is connected to the actuator module 2 by means of three weld connections 11, of which only one weld connection 11 is shown here in the form of a bulge on the support element 3.

Figure 2:
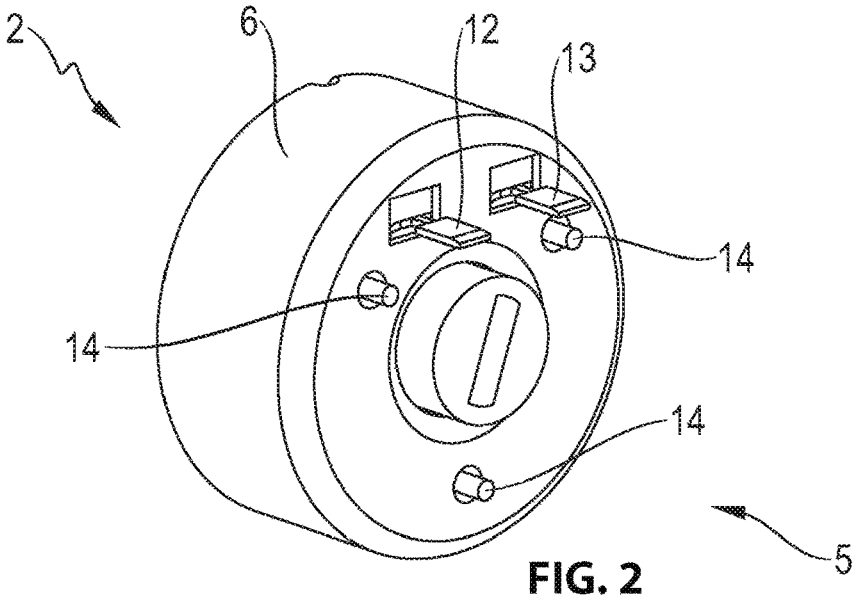
FIG. 2 illustrates detail II from FIG. 1 in a perspective view.
Figure 3:
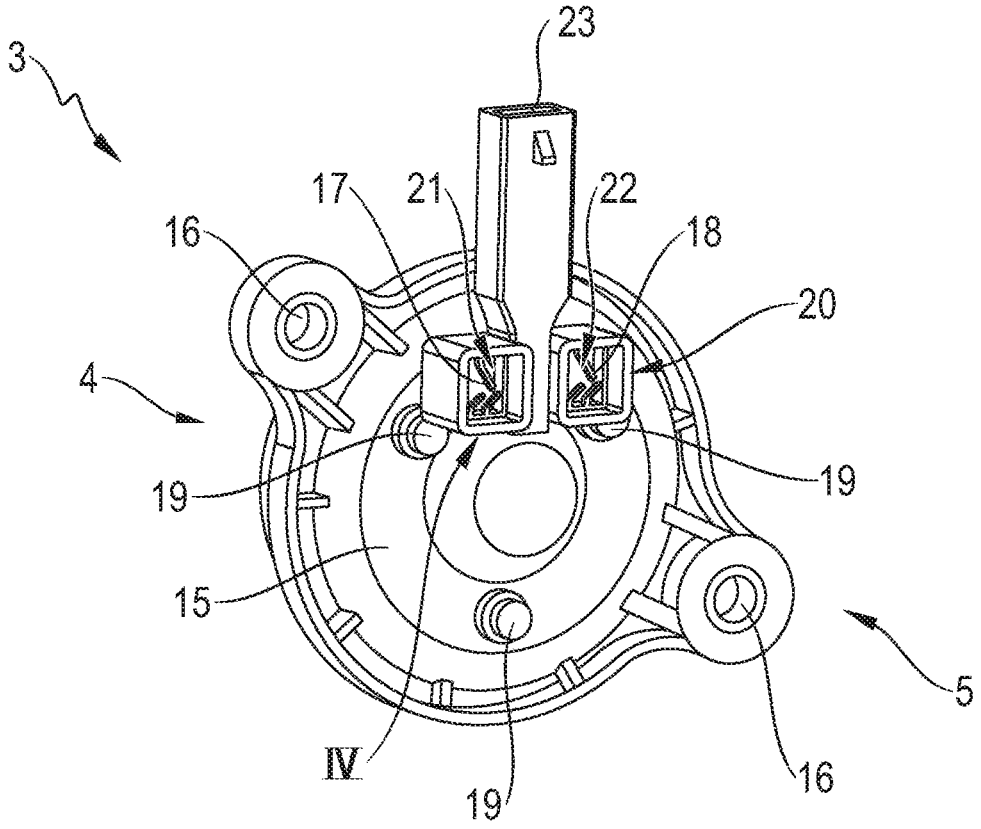
FIG. 3 illustrates detail III from FIG. 1 in a perspective view.

Further components of the actuator module 2 and support element 3 are presented in the descriptions of FIGS. 2 and 3. The actuator module 2 is shown in FIG. 2 and the support element 3 in FIG. 3.

FIG. 2 shows the actuator module 2 from FIG. 1. As well as the housing 6, here a first actuator contact 12 and a second actuator contact 13 are shown, together with three pins 14. All these components 12, 13, 14 protrude from the housing 6 in the direction of the support element side 5. The actuator contacts 12, 13 are provided for electrical contacting with a clamping element or clamping means (not shown) of a support element 3. The pins 14 are provided for insertion in depressions 19 of the support element 3, whereby the support element 3 can be positioned precisely on the actuator module 2 and be welded thereto.

FIG. 3 shows a support element 3 from FIG. 1 which is provided for receiving an actuator module 2 on the actuator module side 4. The support element 3 here has a surrounding plastic molding 15. The plastic molding 15 is formed with two screw openings 16, a first pocket 17 and a second pocket 18, and three depressions 19. The pockets 17, 18 are designed as through openings which are closed oil-tightly after mounting on an actuator module 2 on the support element side 5. The three depressions 19 are made in the plastic molding 15 from the actuator module side 4, so in this perspective view they are visible as bulges in the direction of the support element side 5.

An elastic clamping element 20 is arranged inside the plastic molding 15 and is partly visible through the pockets 17, 18. The clamping element 20 here has the form of two clamping means 21, 22, wherein the first clamping means 21 is accessible via the first pocket 17, and the second clamping means 22 via the second pocket 18. The clamping means 21, 22 are provided to create an electrical contacting with the actuator contacts 12, 13 of the actuator module 2 inserted into the pockets 17, 18 from the actuator module side 4. Inside the plastic molding 15, the clamping means 21, 22 are connected to an electrical terminal 23. By means of the three depressions 19, the support element 3 can be positioned on the actuator module 2, wherein pins 14 protrude from the actuator module 2 and are introduced into the depressions 19 and welded thereto, preferably by means of ultrasound welding.

Figure 4:
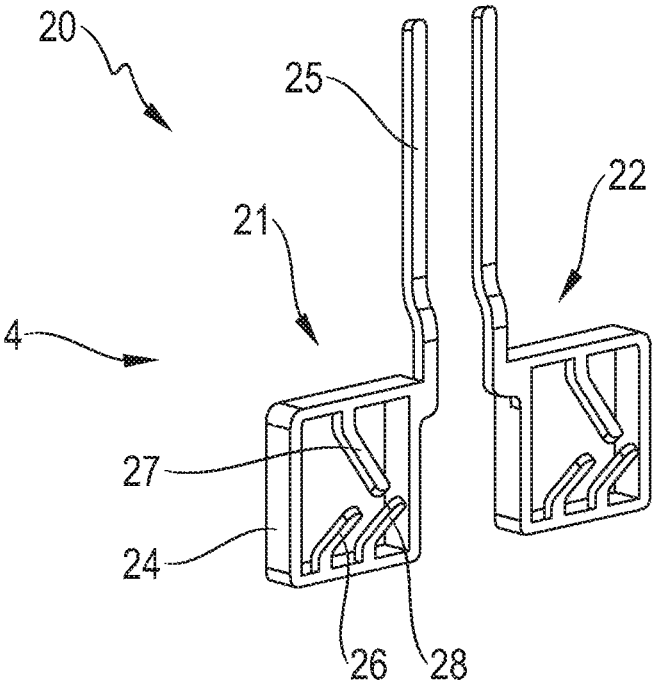
FIG. 4 illustrates detail IV from FIG. 3 in a perspective view.

FIG. 4 shows the elastic clamping element 20 from FIG. 3 which is formed from the first clamping means 21 and the second clamping means 22. Since the clamping means 21, 22 are similar in function and basic structure, only the first clamping means 21 is described in detail here. The first clamping means 21 has a frame element 24 from which four arms 25, 26, 27, 28 protrude. These are firstly a connecting arm 25 which is arranged protruding outwardly from the frame element 24 and is intended to guarantee a connection with an electrical terminal of the support element 3. The connecting arm 25 runs in the direction of the longitudinal axis of the clamping element 20.

Secondly, a first clamping arm 26, a second clamping arm 27 and a third clamping arm 28 are arranged protruding inwardly from the frame element 24. The clamping arms 26, 27, 28 together form an M-shaped receiver and are each bent in the direction of the support element side 5. Because of the bent arrangement of the clamping arms 26, 27, 28, an actuator contact 12, 13 can be introduced more easily into a clamping means 21, 22 from the actuator module side 4. Also, subsequent release or extraction of the actuator contact 12, 13 is more difficult since the clamping arms 26, 27, 28 act as a claw. The M-shaped receiver also allows variously formed actuator contacts, with different shape, size and orientation, to be gripped or clamped.

All features explained and shown in connection with individual embodiments of the invention may be provided in various combinations in the object according to the invention in order to exercise their advantageous effects simultaneously. The scope of protection of the present invention is specified by the claims and is not restricted by the features explained in the description or shown in the figures.

Thus a support arrangement according to the invention may, in further embodiments (not shown here), comprise further interface-specific elements, functions and properties. For example, the number and position of the screw openings or bores is freely selectable, and/or a molded pressure limiter is provided for the screw openings or screw fixings. Furthermore, alternative fixing methods such as rotary locking or latch functions are possible. The support element may also contain information such as an identification number, a customer identification and/or other notes, which are for example glued or printed onto the support element. Also, a composition and orientation of actuator contacts or plug pins and the pins of the actuator module, and an electrical connection of the support element, are freely selectable. If necessary, the support element also has functions of supporting seals and/or wiring harnesses.

What is claimed is:

1. A support arrangement for an actuator of a cam phaser, the support arrangement comprising:

an actuator module including an actuator; and a support element configured to support the actuator module on a camshaft, wherein the actuator module is connected to the support element by an electrical contact arrangement configured to actuate the actuator, wherein the electrical contact arrangement includes an elastic clamping element, wherein the elastic clamping element includes a first clamping arm configured to clamp and fix an actuator contact, wherein the elastic clamping element includes a second clamping arm configured to clamp and fix the actuator contact, wherein the second clamping arm is arranged opposite to the first clamping arm, wherein the clamping element includes a third clamping arm configured to clamp and fix the actuator contact, and wherein the first clamping arm, the second clamping arm and the third clamping arm together form an M-shaped receiver for the actuator contact.

2. The support arrangement according to claim 1, wherein the Elastic clamping element is arranged at the support element.

3. The support arrangement according to claim 1, wherein the elastic clamping element includes a first clamping device and a second clamping device.

4. The support arrangement according to claim 3, wherein the first clamping device and the second clamping device are arranged parallel to each other.

5. The support arrangement according to claim 1, wherein the first clamping arm, the second clamping arm and a third clamping arm is arranged at an angle between 0° and 80° or between 10° and 60° relative to a longitudinal axis of the elastic clamping element.

6. The support arrangement according to claim 1, wherein the first clamping arm, the second clamping arm and a third clamping arm is bent in a direction facing away from the actuator module in a state in which the actuator module is supported at the support element.

7. The support arrangement according to claim 1, wherein the clamping element is arranged in at least one sealed pocket of the support element.

8. The support arrangement according to claim 1, wherein the support element includes a surrounding plastic molding.

9. The support arrangement according to claim 1, wherein the support element is welded to the actuator module.

10. The support arrangement according to claim 1, wherein the actuator module includes at least one outward protruding pin which is introducible into a corresponding depression of the support element.

11. The support arrangement according to claim 10, wherein the pin is configured to be welded to the support element.

* * * * *